US010602856B2

(12) United States Patent
Mankame et al.

(10) Patent No.: US 10,602,856 B2
(45) Date of Patent: Mar. 31, 2020

(54) CONTOURED CUSHIONS

(71) Applicant: GM GLOBAL TECHNOLOGY OPERATIONS LLC, Detroit, MI (US)

(72) Inventors: Nilesh D. Mankame, Ann Arbor, MI (US); Onkar Akolkar, Warren, MI (US); Brennon L. White, Novi, MI (US); Edward T. Kuczynski, Bloomfield Hills, MI (US); Daniel W. Booth, Troy, MI (US); Daniel J. Ridgeway, Dearborn, MI (US); Udit Patel, Rochester, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/107,122

(22) Filed: Aug. 21, 2018

(65) Prior Publication Data

US 2020/0060432 A1 Feb. 27, 2020

(51) Int. Cl.

| | |
|---|---|
| ***A47C 7/02*** | (2006.01) |
| ***A47C 31/12*** | (2006.01) |
| ***A47C 27/08*** | (2006.01) |
| ***A47C 7/18*** | (2006.01) |

(52) U.S. Cl.

CPC ..... *A47C 31/126* (2013.01); *A47C 7/18* (2013.01); *A47C 27/088* (2013.01)

(58) Field of Classification Search

CPC ..... A47C 7/021; A47C 7/18; A47C 7/029; A61G 5/1043; A61G 5/1045

USPC ..... 297/180.11, 452.26, 452.25, 452.23, 297/452.22, 452.28, 452.21, 452.27, 229, 297/219.1; 5/654, 653

See application file for complete search history.

(56) References Cited

U.S. PATENT DOCUMENTS

| | | | | | |
|---|---|---|---|---|---|
| 4,660,238 | A * | 4/1987 | Jay | A61F 5/01 | 5/654 |
| 4,755,411 | A * | 7/1988 | Wing | A47C 7/18 | 264/45.1 |
| 4,761,843 | A * | 8/1988 | Jay | A61F 5/01 | 5/654 |
| 4,837,881 | A * | 6/1989 | Kondo | A47C 7/18 | 5/653 |
| 4,995,926 | A * | 2/1991 | Urai | A47C 7/18 | 156/155 |
| 6,625,830 | B2 * | 9/2003 | Lampel | A47C 27/146 | 297/452.26 |
| 7,225,486 | B2 * | 6/2007 | Jackson, III | A47G 9/1027 | 5/653 |
| 7,673,939 | B2 * | 3/2010 | Taguchi | B60N 2/5816 | 297/218.1 |
| 9,609,951 | B2 * | 4/2017 | Chan | A47C 7/746 | |
| 2005/0067877 | A1 * | 3/2005 | Matsushima | B60N 2/66 | 297/452.48 |
| 2006/0273650 | A1 * | 12/2006 | Embach | A47C 7/18 | 297/452.27 |
| 2015/0108802 | A1 * | 4/2015 | Krishtul | A47C 7/029 | 297/283.1 |
| 2015/0122266 | A1 * | 5/2015 | Saunders | A61G 5/1043 | 128/845 |

* cited by examiner

*Primary Examiner* — Chi Q Nguyen

(57) ABSTRACT

A seat cushion is provided. The seat cushion includes a first cushion comprising a top side and a bottom side. The bottom side or the top side includes a contoured area and the contoured area has a convex or a concave shape.

9 Claims, 3 Drawing Sheets

CONTOURED CUSHIONS

INTRODUCTION

Apparatuses consistent with exemplary embodiments relate to chairs and cushions. More particularly, apparatuses and methods consistent with exemplary embodiments relate to seat cushions embedded or integrated into chairs.

SUMMARY

One or more exemplary embodiments provide a contoured seat cushion. More particularly, one or more exemplary embodiments provide a seat cushion with a contour on a bottom side or a top side.

According to an aspect of an exemplary embodiment, a seat cushion is provided. a first cushion comprising a top side and a bottom side. The bottom side or the top side includes a contoured area, the contoured area having a convex or a concave shape.

The contoured area may include a backfill material configured to restore a flat or convex nominal surface, the backfill material having an effective elastic modulus that is less than an elastic modulus of the cushion.

The contoured area may be a second contoured area, and the top side may include the second contoured area, the second contoured area being a depression in the top side of the cushion or being a convex shape.

The first cushion may include a tapered edge or a fillet on a front edge of the top side of the cushion or a tapered edge or a fillet on a rear edge of the top side of the cushion.

The contoured area may be a first contoured area, the bottom side may be the first contoured area, and the first contoured area may have a concave shape.

The cushion may further include a support partially covering the first contoured area, and contoured in substantially a same contour as the first contoured area. The support may fully cover the first contoured area or fully cover the bottom side of the cushion. The support may be one or more from among a rubber, an elastomer, a polymer, a thermoplastic elastomer (TPE) or a silicone material.

The support may be at least ten times stiffer than the first cushion, have an elastic strain limit of greater than twenty percent, or a deflection that is less than 1/20th of a deflection of the cushion.

The cushion may include a second cushion including a second top side and a second bottom side and the contoured area may be a first contoured area, the bottom side may include the first contoured area, and the first contoured area may a concave shape. Moreover, the second top side may include a third contoured area, the third contoured area being a depression in the second top side of the second cushion, and the first cushion is stacked on top of the second cushion.

The first cushion may include two first cushions and the second cushion may include two second cushions. The two first cushions and the two second cushions may be stacked in an order of first cushion, second cushion, first cushion, and second cushion from top to bottom.

The first cushion may include a material including one or more from among foam, polymeric lattices, elastomeric lattices, polymeric honeycombs, and elastomeric honeycombs.

The first cushion maybe formed by a foam molding process and the contoured area may be backfilled with a fill material.

According to an aspect of another exemplary embodiment, a vehicle seat including the cushion is provided.

Other objects, advantages and novel features of the exemplary embodiments will become more apparent from the following detailed description of exemplary embodiments and the accompanying drawings.

BRIEF DESCRIPTION OF THE DRAWINGS

The disclosed examples will hereinafter be described in conjunction with the following drawing figures, wherein like numerals denote like elements, and wherein.

DETAILED DESCRIPTION

Figure 1:
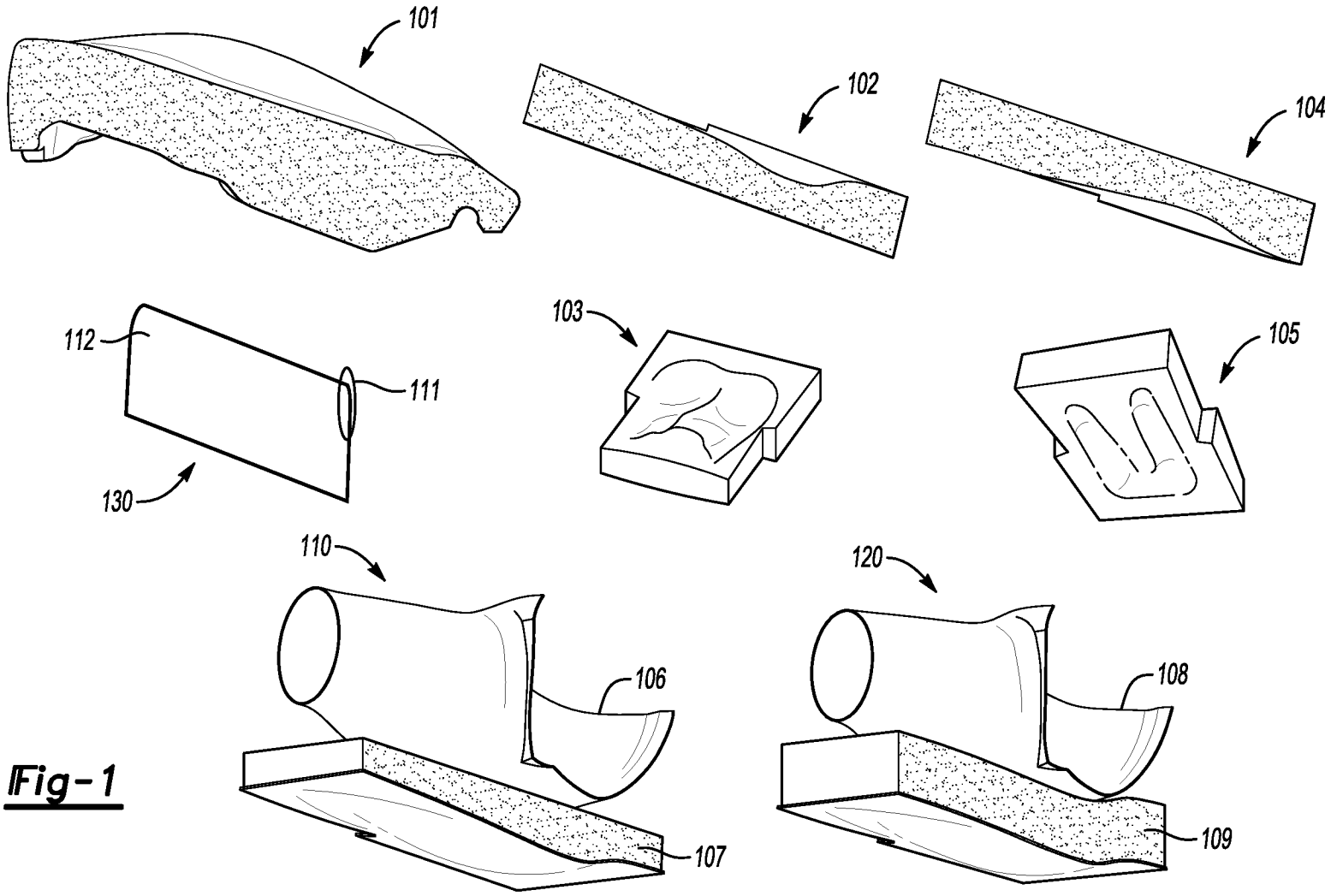
FIG. 1 shows examples of contoured seat cushions according several aspects of an exemplary embodiment.

A seat cushion will now be described in detail with reference to FIGS. 1-3 of the accompanying drawings in which like reference numerals refer to like elements throughout. The following disclosure will enable one skilled in the art to practice the inventive concept. However, the exemplary embodiments disclosed herein are merely exemplary and do not limit the inventive concept to exemplary embodiments described herein. Moreover, descriptions of features or aspects of each exemplary embodiment should typically be considered as available for aspects of other exemplary embodiments.

It is also understood that where it is stated herein that a first element is "connected to," "attached to," "formed on," or "disposed on" a second element, the first element may be connected directly to, formed directly on or disposed directly on the second element or there may be intervening elements between the first element and the second element, unless it is stated that a first element is "directly" connected to, attached to, formed on, or disposed on the second element. Throughout the disclosure, one or more of the elements disclosed may be combined into a single apparatus or into one or more apparatuses.

Seat cushions may be portable or may be integrated into seats to provide comfort to a seat occupant. The seat cushions may be molded into various forms and may protect an occupant of a seat from discomfort caused by rigid, structural and/or other elements in a seat. Generally, seat cushion inserts include flat surfaces. However, due to the various shapes and sizes of occupants, the non-uniform distribution of an occupant's weight against the seat cushion, and the differences in pressure sensitivity or tolerance of human body anatomical features, it is desirable to provide a seat cushion that compensates for high or low-pressure conditions on the seat cushion. Thus, contouring the cushion in highly pressure sensitive areas that experience a greater force from a seated occupant will provide a more comfortable seat for the occupant, decrease pressure on the occupant's body, and enable a more comfortable and durable seat for the occupant.

FIG. 1 shows examples of contoured seat cushions according several aspects of an exemplary embodiment.

Referring to FIG. 1, examples of seat cushions are shown. Seat cushion 101 is an example of a baseline seat cushion. Seat cushion 102 is an example of a seat cushion that is contoured on the top side 103 of the cushion. Seat cushion 104 is an example of a seat cushion that is contoured on the bottom side 105 of the cushion. The contour on the top side is in the form of an upside-down arch, depression, or other concave shape and the contour on the bottom may be in the form of an arch or other convex shape.

According to an example, a seat cushion 110 includes a contour on the bottom side of the cushion 107. According to another example, a seat cushion 120 may include a contour on the bottom side and the top side of the cushion 109. According to yet another example, a cross section view of seat cushion 130 shows an example of tapers in the top front 111 and top rear 112 of the seat cushion 130. These tapers help relieve pressure on occupants that may be seated on the seat cushion. Further, legs 106 and 108 are shown to illustrate how the cushions would receive a person sitting on the cushion or in a chair containing the cushion.

The contoured seat cushions may be foam molded by shooting foam into a mold. Moreover, multi-layered seat cushions may be foam molded in separate layers that are shot sequentially or layers created by a single mold with inflatable inserts that are retracted after the foam has set. Alternatively, the layers can be foam molded separately and bonded after being molded.

Figure 2:
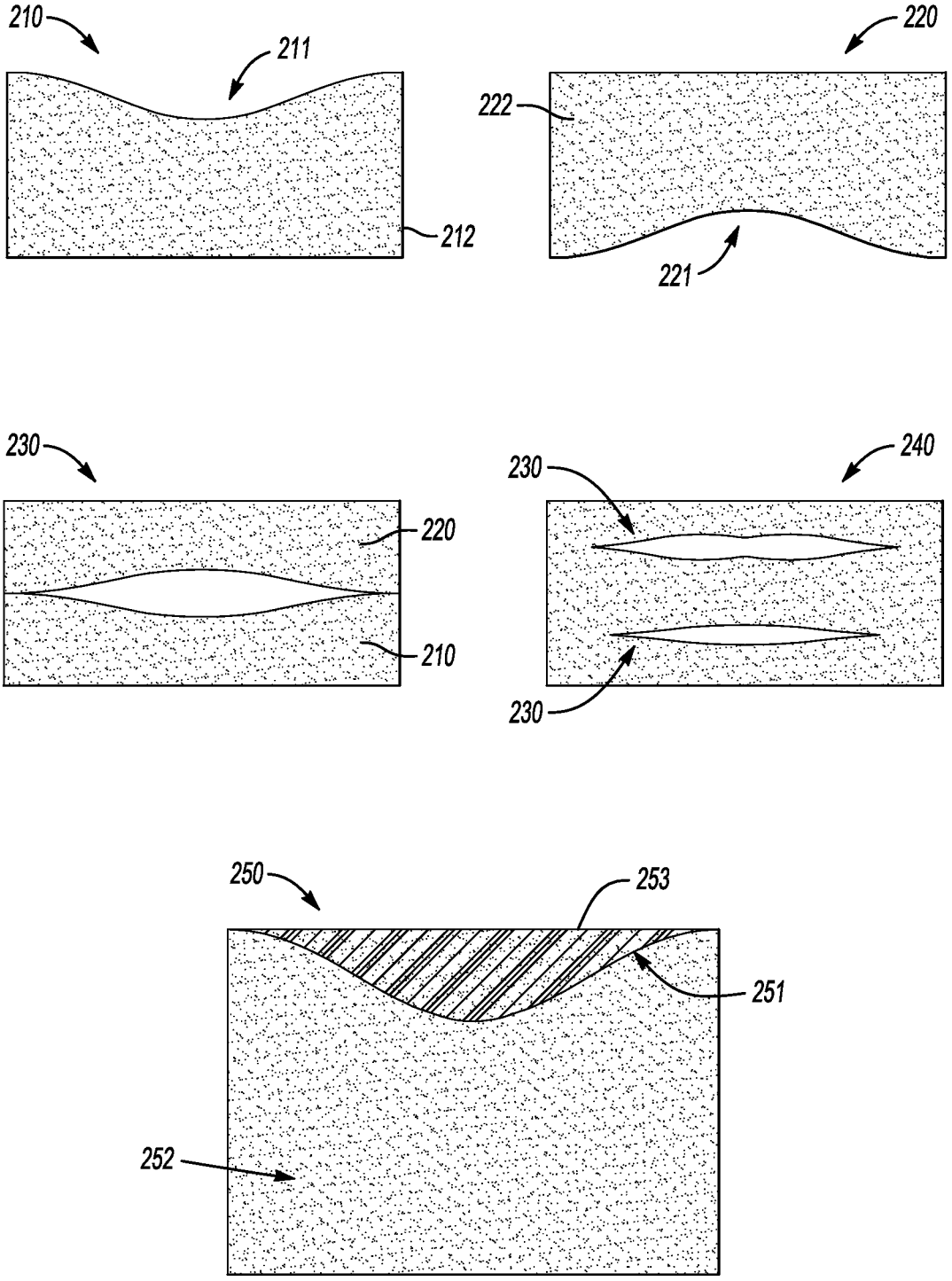
FIG. 2 shows cross sections of contoured seat cushions according several exemplary embodiments.

FIG. 2 shows cross sections of contoured seat cushions according several exemplary embodiments.

Referring to FIG. 2, example cross sections for seat cushions 210-250 are shown. Seat cushion 210 includes a contour 211 on the top side or A-side of cushion 212. Seat cushion 220 includes a contour 221 on the bottom side or B-side of cushion 222. Seat cushion 230 includes seat cushion 220 stacked on top of seat cushion 210. Seat cushion 240 includes two of seat cushion 230 stacked on top of each other. Finally, seat cushion 250 is similar seat cushion 210 except the contour 251 is filled with a fill material 253 on the top side of the cushion 252. The fill material 253 has an elastic modulus that is less than an elastic modulus of the cushion 252. An example of fill material 253 may be a gel substance. The fill material 253 may be added to the cushion 252 after form molding the cushion or the fill material 253 may be manufactured separately and bonded to the cushion 252.

Figure 3:
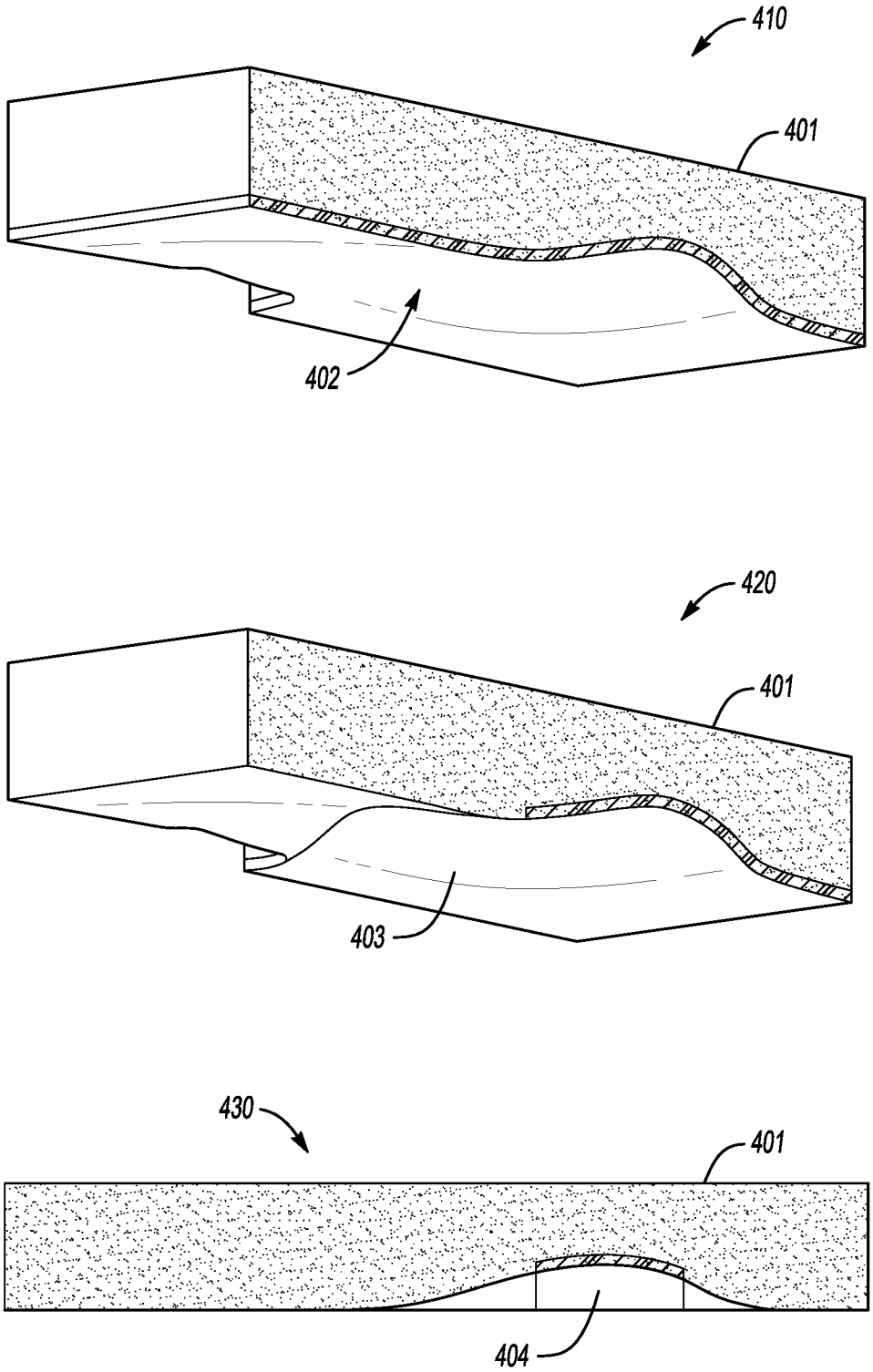
FIG. 3 shows examples of contoured seat cushions with a support according to several aspects of exemplary embodiments.

FIG. 3 shows examples of contoured seat cushions with a support according to several aspects of exemplary embodiments.

Referring to FIG. 3, examples of seat cushion 401 with a contoured B-side or bottom side supported by a support 402 that may be rigid or semi rigid are shown. The support may be made of a material that is stiffer than the cushion, e.g., approximately ten times stiffer, but may be compliant and have a high elastic strain limit of greater than twenty percent. The deflection of the support may less than 1/20 the deflection of the of the cushion.

In one example, the support 402 may extend so that supports substantially the entire bottom side of the cushion 401 as shown in illustration 410. In another example, the support 403 may extend so that supports substantially the entire contour while leaving the remaining B-side or bottom of the seat cushion 401 uncovered as shown in illustration 420. In yet another example, the support 404 may extend so that it partially covers the contour while leaving remaining part of the contour and the B-side or bottom of the cushion uncovered as shown in illustration 430.

The supports 402-404 may be contoured in substantially the same contour as the contoured area of seat cushion 401. The supports 402-404 may be made of TPE or a silicone material. According to an example, the supports 402-404 may be separately manufactured and then placed in the mold used for foam molding the cushion where foam may then be shot over the supports 402-404. Alternatively, the supports 402-404 may be bonded to the foam.

One or more exemplary embodiments have been described above with reference to the drawings. The exemplary embodiments described above should be considered in a descriptive sense only and not for purposes of limitation. Moreover, the exemplary embodiments may be modified without departing from the spirit and scope of the inventive concept, which is defined by the following claims.

What is claimed is:

1. A seat cushion comprising:

a first cushion comprising a top side and a bottom side, wherein the top side comprises a contoured area, the contoured area having a concave shape, wherein the contoured area comprises a backfill material configured to restore a flat or convex nominal surface, the backfill material having an effective elastic modulus that is less than an elastic modulus of the cushion, wherein the first cushion comprises a tapered edge or a fillet on a front edge of the top side of the first cushion or a tapered edge or a fillet on a rear edge of the top side of the first cushion, and wherein the backfill material is at least ten times stiffer than the first cushion, has an elastic strain limit of greater than twenty percent, or has a deflection that is less than 1/20th of a deflection of the cushion.

2. A vehicle seat comprising the cushion of claim 1.

3. The cushion of claim 1, wherein the first cushion comprises a material including one or more from among foam, polymeric lattices, elastomeric lattices, polymeric honeycombs, and elastomeric honeycombs.

4. The cushion of claim 1, wherein the first cushion is formed by a foam molding process.

5. A seat cushion comprising:

a first cushion comprising a top side and a bottom side comprising a first contoured area, the first contoured area having a concave shape; and a support partially covering the first contoured area, and contoured in substantially a same contour as the first contoured area, wherein the support fully covers the first contoured area or the bottom side of the cushion, wherein the support is at least ten times stiffer than the first cushion, has an elastic strain limit of greater than twenty percent, or has a deflection that is less than 1/20th of a deflection of the cushion.

6. The cushion of claim 5, wherein the support comprises one or more from among a rubber, an elastomer, a polymer, a thermoplastic elastomer (TPE) or a silicone material.

7. A seat cushion comprising:

a first cushion comprising a top side and a bottom side; and a second cushion comprising a second top side and a second bottom side, wherein the bottom side or the top side comprises a contoured area, the contoured area having a convex or a concave shape, wherein the contoured area comprises a first contoured area, the bottom side comprises the first contoured area, the first contoured area having a concave shape, wherein the second top side comprises a third contoured area, the third contoured area being a depression in the second top side of the second cushion, and wherein the first cushion is stacked on top of the second cushion.

8. The cushion of claim 7, wherein the first cushion comprises two first cushions and the second cushion comprises two second cushions, wherein the two first cushions and the two second cushions are stacked in an order of first cushion, second cushion, first cushion, and second cushion from top to bottom.

9. The cushion of claim 7, wherein the contoured area is backfilled with a fill material.

* * * * *